US010662562B2

(12) United States Patent
Evrard et al.

(10) Patent No.: US 10,662,562 B2
(45) Date of Patent: May 26, 2020

(54) INSTALLATION AND A METHOD FOR NEEDLING A FIBER PREFORM WHILE CONTROLLING THE CONTACT PRESSURE OF THE STRIPPER

(71) Applicant: ARIANEGROUP SAS, Paris (FR)

(72) Inventors: Hervé Evrard, Le Haillan (FR); Gareth Clarke, Saint-Medard-en-Jalles (FR); Edouard Borie, Eysines (FR); Thierry Constant, Ludon Medoc (FR)

(73) Assignee: ARIANEGROUP SAS, Paris (FR)

( * ) Notice: Subject to any disclaimer, the term of this patent is extended or adjusted under 35 U.S.C. 154(b) by 240 days.

(21) Appl. No.: 15/936,765

(22) Filed: Mar. 27, 2018

(65) Prior Publication Data

US 2018/0274144 A1 Sep. 27, 2018

(30) Foreign Application Priority Data

Mar. 27, 2017 (FR) ..... 17 52511

(51) Int. Cl.
*D04H 18/02* (2012.01)
*D04H 1/46* (2012.01)
*D04H 3/105* (2012.01)

(52) U.S. Cl.
CPC ..... *D04H 18/02* (2013.01); *D04H 1/46* (2013.01); *D04H 3/105* (2013.01)

(58) Field of Classification Search
CPC ..... D04H 18/02; D04H 18/00; D04H 1/46; D04H 3/102; D04H 3/105; D04H 5/02; D04H 13/005; D05B 29/02; D05B 29/00
(Continued)

(56) References Cited

U.S. PATENT DOCUMENTS 2,896,303 A * 7/1959 Morrill ..... D04H 18/02 28/115
3,909,893 A * 10/1975 Wilde ..... D04H 3/07 28/110

(Continued)

FOREIGN PATENT DOCUMENTS

CN 2420304 Y 2/2001
CN 202466129 U 10/2012

(Continued)

OTHER PUBLICATIONS

Search Report as issued in French Patent Application No. 1752511, dated Oct. 5, 2017.

*Primary Examiner* — Amy Vanatta
(74) *Attorney, Agent, or Firm* — Pillsbury Winthrop Shaw Pittman LLP

(57) ABSTRACT

A needling installation includes a rotary support on which a fiber texture is wound to form a fiber preform, the rotary support being mounted on a frame that is movable along a second axis Y perpendicular to the first axis X; a stripper including one plate including perforations; a needling module having a needle board carrying needles; a contact force application system connected to the stripper; a contact force sensor for providing information representative of the contact force with which the outside face of the plate of the stripper makes contact against the fiber preform, and a controller to control the contact force application system to apply a force to the plate of the stripper that is predetermined as a function of information provided by each contact force sensor and as a function of a target value for a predetermined contact force.

14 Claims, 6 Drawing Sheets

(58) Field of Classification Search
USPC ..... 28/110, 107, 115
See application file for complete search history.

(56) References Cited

U.S. PATENT DOCUMENTS

| | | | | | |
|---|---|---|---|---|---|
| 3,952,121 | A * | 4/1976 | Dilo | D04H 18/00 | 428/34.1 |
| 4,621,662 | A * | 11/1986 | Olry | D04H 18/02 | 138/129 |
| 4,790,052 | A * | 12/1988 | Olry | B29C 33/56 | 156/148 |
| 5,226,217 | A * | 7/1993 | Olry | D04H 18/00 | 28/107 |
| 6,009,605 | A * | 1/2000 | Olry | B29B 11/16 | 28/107 |
| 6,293,210 | B1 * | 9/2001 | Freeman | D04H 18/02 | 112/470.01 |
| 6,360,412 | B1 * | 3/2002 | Duval | D04H 18/02 | 28/107 |
| 6,374,469 | B1 * | 4/2002 | Baudry | D04H 18/02 | 28/107 |
| 2011/0081816 | A1 * | 4/2011 | Halstead | D04H 1/4242 | 442/388 |

FOREIGN PATENT DOCUMENTS

| | | | |
|---|---|---|---|
| CN | 105386241 | A | 3/2016 |
| CN | 105755680 | A | 7/2016 |
| WO | WO 2006/056675 | A1 | 6/2006 |
| WO | WO 2014/017696 | A1 | 1/2014 |

* cited by examiner

INSTALLATION AND A METHOD FOR NEEDLING A FIBER PREFORM WHILE CONTROLLING THE CONTACT PRESSURE OF THE STRIPPER

CROSS-REFERENCE TO RELATED APPLICATIONS

This application claims priority to French Patent Application No. 1752511, filed Mar. 27, 2017, the entire content of which is incorporated herein by reference in its entirety.

FIELD

The invention relates to needling fiber textures that are wound progressively onto a rotary support mounted on a movable frame, in particular in order to make preforms that are to constitute reinforcing structures for parts made of composite material, such as, for example, preforms for parts made of thermostructural composite material.

BACKGROUND

In known manner, and as disclosed in document WO 2006/056675, a needling installation comprises a needling module having a needling head carrying a plurality of needles, the needling module including both needling head drive means for causing the needles to perform reciprocating motion and also a stripper comprising at least one plate having a plurality of perforations, with the needles of the needling head being aligned with the perforations present in the plate of the stripper so as to perform back-and-forth movement through the perforations. The face of the stripper plate that faces away from the needling head is placed in contact with the fiber texture for needling, so as to limit the extent to which the structure expands, in particular while the needles are being withdrawn from the fiber structure.

In Document WO 2006/056675, it is relatively easy to maintain contact between the stripper and the face of the fiber texture for needling since firstly the thickness of the fiber texture does not vary during needling, and secondly the fiber texture is needled while flat, with the texture traveling on a belt past the needling head.

Maintaining good contact between a stripper and the needling face of a fiber texture is more difficult when the texture is wound on a mandrel and when its thickness varies continuously during needling, requiring changes of positioning between the needling module carrying the stripper and the fiber texture.

SUMMARY

An aspect of the invention seeks to avoid such drawbacks and for this purpose it proposes a needling installation comprising:

- a rotary support extending along a first axis X and on which a fiber texture can be wound so as to form a fiber preform for a body of revolution, the rotary support being mounted on a frame that is movable along a second axis Y perpendicular to the first axis X;
- a stripper comprising at least one plate extending at least along the first axis X and including a plurality of perforations, the plate presenting an inside face and an outside face, the outside face being present beside the rotary support;
- a needling module having a needling head and a needle board carrying a plurality of needles, the needle board facing the inside face of the plate of the stripper, the needles being in alignment with the perforations present in the plate of the stripper, the needling head having a drive system configured to drive the needle board to impart reciprocating motion to the needles along the second axis Y relative to the plate of the stripper;
- a contact force application system connected to the stripper;
- at least one contact force sensor for providing information representative of the contact force with which the outside face of the plate of the stripper makes contact against the fiber preform; and
- a controller configured to control the contact force application system so as to apply a force to the plate of the stripper that is predetermined as a function of information provided by each contact force sensor and as a function of at least one target value for a predetermined contact force.

It is thus possible to provide good contact for the stripper against the fiber texture independently of changes of position between the fiber texture and the stripper.

In a first particular aspect of the needling installation of the invention, the stripper is connected to the needling head by arms, each including an oleopneumatic actuator, at least one of the arms further including a contact force sensor.

In a second particular aspect of the needling installation of the invention, a target value for a contact force lies in the range 10 newtons (N) to 1000 N.

According to an optional characteristic of the needling installation of the invention, the needling module is suitable for moving along the first axis X. The movement of the needling module along the axis X serves in particular to needle the entire width of the fiber preform when the preform presents a width that is greater than the zone covered by the needles of the needling head in the direction of the axis X.

According to another optional characteristic of the needling installation of the invention, the outside face of the plate of the stripper presents concave curvature. This concave curvature enables the shape of the fiber preform to be fitted better and consequently makes it possible to improve the contact of the outside face of the plate of the stripper against the exposed face of the fiber preform.

An aspect of the invention also provides a method of needling a fiber preform in a needling installation comprising:

- a rotary support extending along a first axis X and on which a fiber texture is wound so as to form a fiber preform for a body of revolution, the rotary support being mounted on a frame that is movable along a second axis Y perpendicular to the first axis X;
- a stripper comprising at least one plate extending at least along the first axis X and including a plurality of perforations, the plate presenting an inside face and an outside face, the outside face being present beside the rotary support;
- a needling module having a needling head and a needle board carrying a plurality of needles, the needle board facing the inside face of the plate of the stripper, the needles being in alignment with the perforations present in the plate of the stripper, the needling head having a drive system configured to drive the needle board to impart reciprocating motion to the needles along the second axis Y relative to the plate of the stripper;
- a contact force application system connected to the stripper; and at least one contact force sensor for providing information representative of the force with which the outside face of the plate of the stripper makes contact against the fiber preform;

the method comprising putting the outside face of the plate of the stripper into contact with the exposed face of the fiber preform and needling the preform; and the method being characterized in that it further comprises a step of controlling the contact force applied by the plate of the stripper on the fiber preform, by controlling the contact force application system so as to apply a force to the plate of the stripper that is predetermined as a function of information provided by each contact force sensor and as a function of at least one value for a predetermined contact force.

According to a first particular aspect of the needling method of the invention, the stripper is connected to the needling head by arms, each including an oleopneumatic actuator, at least one of the arms further including a contact force sensor.

According to a second particular aspect of the needling method of the invention, a target value for a contact force lies in the range 10 N to 1000 N.

According to an optional characteristic of the needling method of the invention, the needling module is suitable for moving along the first axis X.

According to another optional characteristic of the needling method of the invention, the outside face of the plate of the stripper presents concave curvature.

BRIEF DESCRIPTION OF THE DRAWINGS

The invention can be better understood on reading the following description given by way of non-limiting indication and with reference to the accompanying drawings, in which.

DETAILED DESCRIPTION

Figure 1:
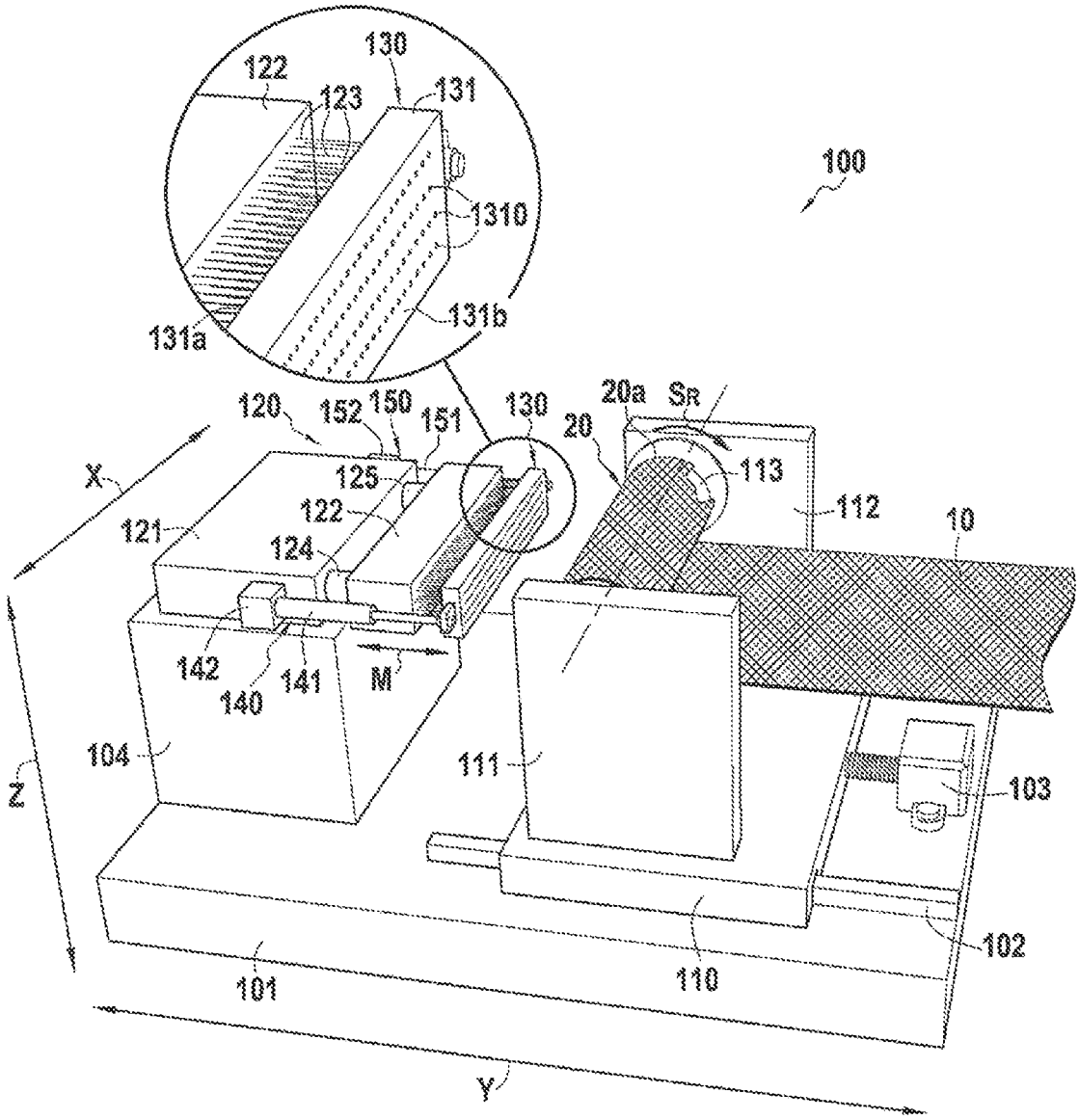
FIGS. 1 and 2 are diagrammatic perspective views of a needling installation in an embodiment of the invention.
Figure 2:
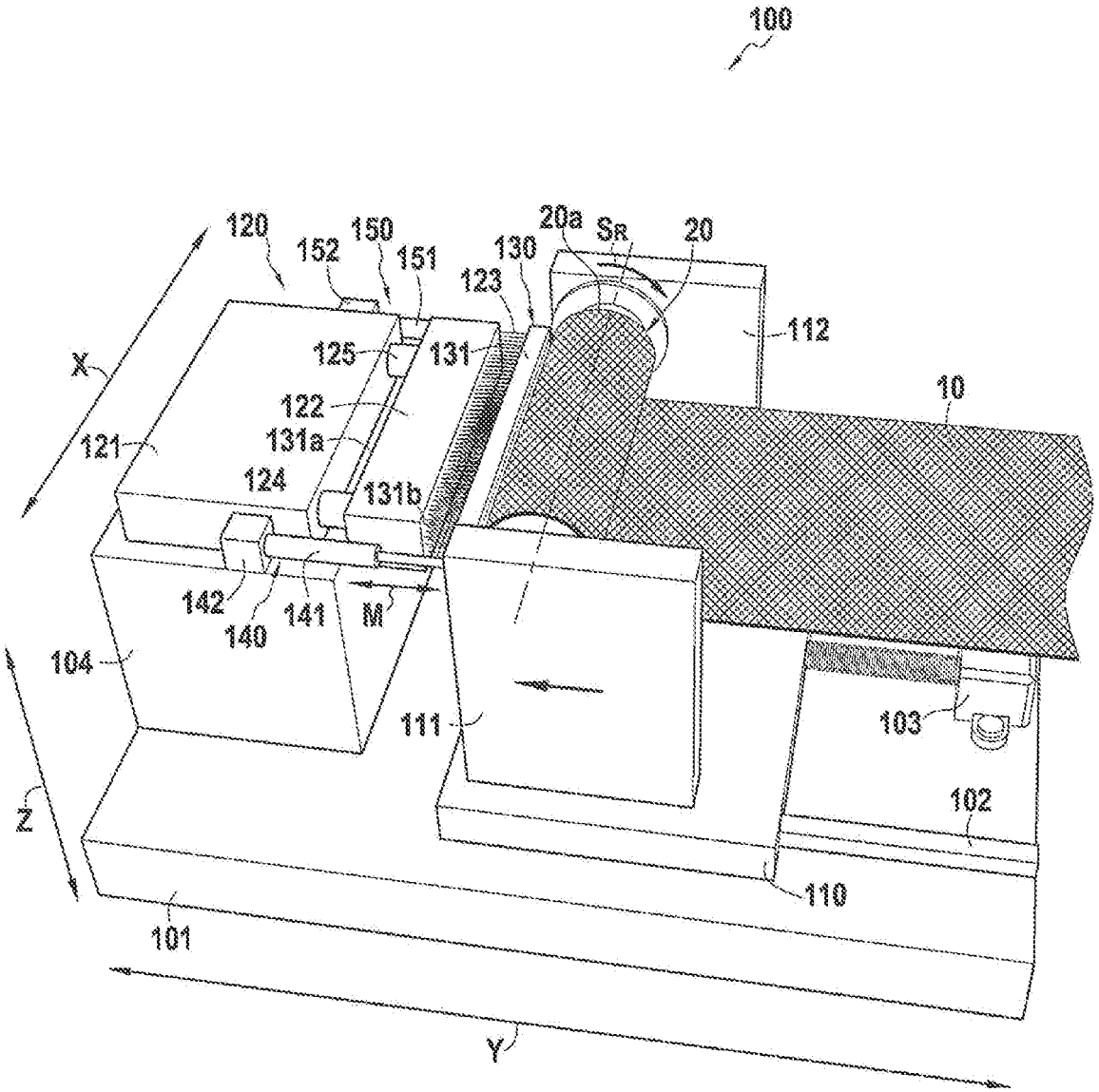

FIGS. 1 and 2 are diagrams showing a needling installation 100 in accordance with an embodiment of the invention. The installation 100 comprises a stationary frame 101 having a carriage platform 110 mounted thereon. The carriage platform 110 stands on rails 102 and is connected to an actuator 103, in this example a motor with a wormscrew, serving to move the carriage platform 110 along an axis Y that is parallel to the rails 102. The installation 100 also has a rotary support or mandrel 113 carried on a rotary spindle (not shown in FIGS. 1 and 2) and supported by two spindle holders 111 and 112, at least one of which includes a motor (FIG. 1) for driving the mandrel 113 in rotation in the direction represented by arrow SR in FIGS. 1 and 2. The spindle holders 111 and 112 are fastened on the carriage platform 110. A fiber texture 10 in the form of a strip is wound progressively onto the mandrel 113 so as to constitute a fiber preform 20 that is in the form of a body of revolution once it has been needled.

The installation 100 also has a needling module 120 constituted by a needling head 121 fastened on a needling frame 104, itself fastened on the stationary frame 101, a needle board 122 mounted on the needling head and carrying a plurality of needles 123, and a stripper 130. The stripper 130 comprises at least one plate 131 extending at least along an axis X perpendicular to the axis Y and including a plurality of perforations 1310, the plate 131 having an inside face 131*a* and an outside face 131*b*, the outside face 131*b* being present beside the mandrel 113.

Figure 3A:
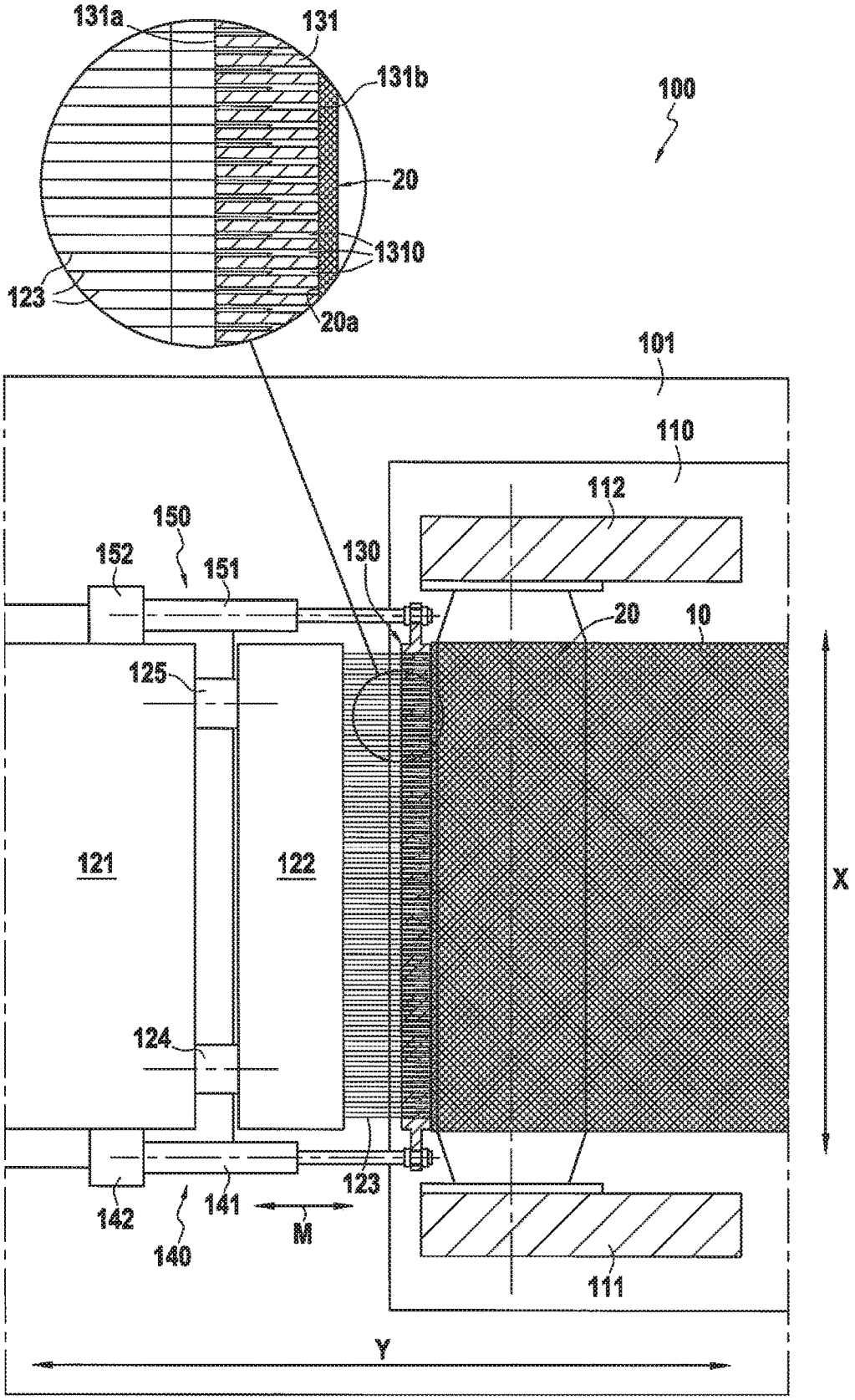
FIGS. 3A and 3B are plan views of the FIG. 2 needling installation showing the needles of the needling head respectively in a retracted position and in a deployed position.
Figure 3B:
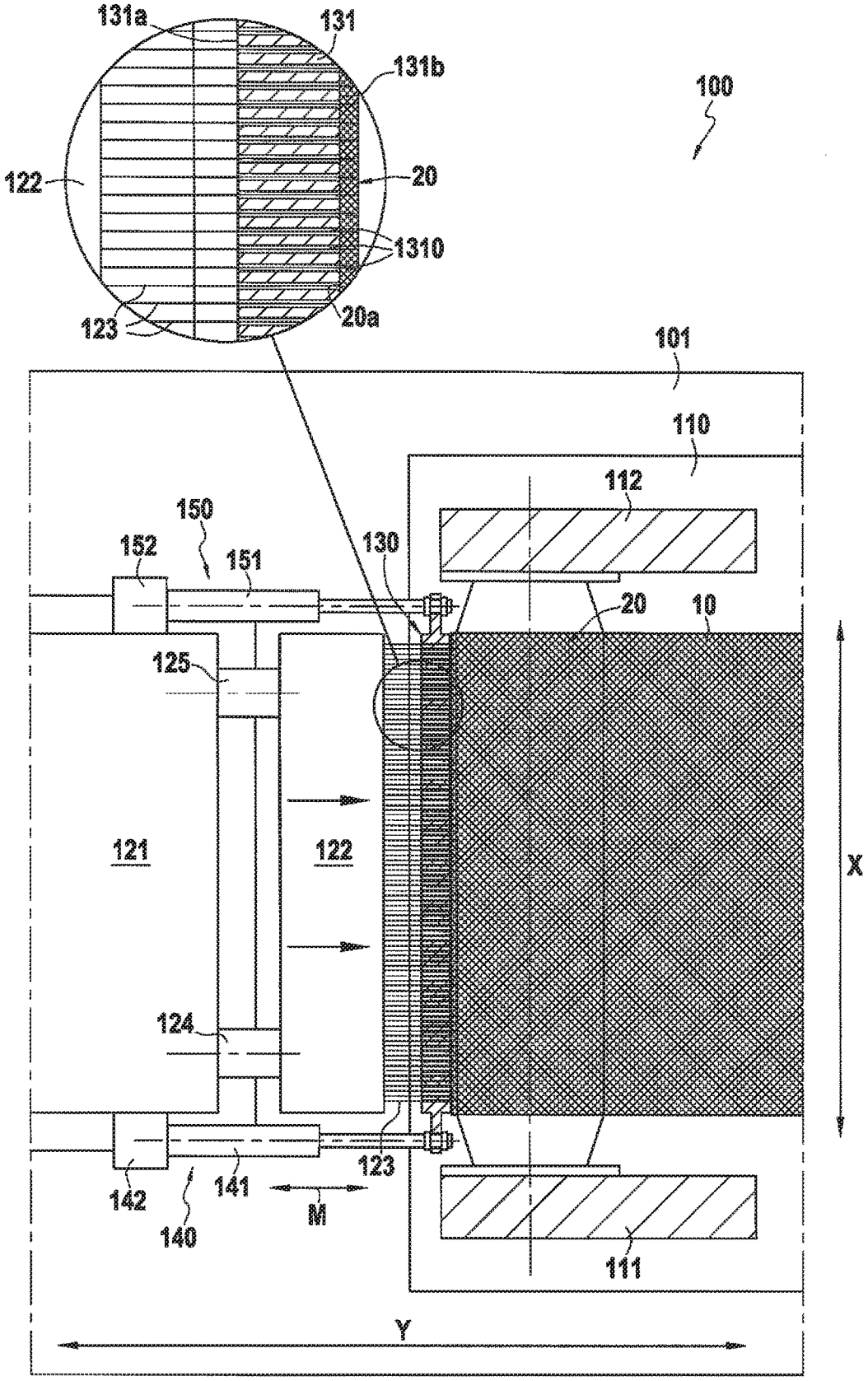
Figure 4:
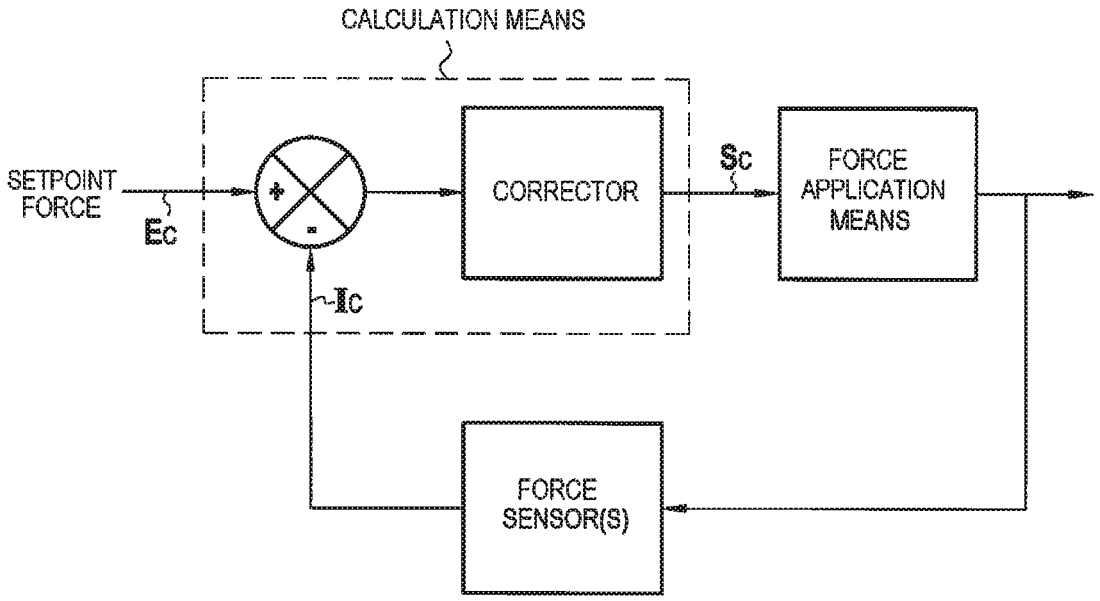
FIG. 4 is a diagram of a regulator loop used in the needling installation of the invention.

As shown in FIGS. 3A-B and 4, the stripper 130 is connected to the needling head 121 by a first arm 140 including an actuator 141 and a second arm 150 including an actuator 151. In the presently-described example, the actuators 141 and 151 are oleopneumatic actuators. As explained below, the actuators 141 and 151 constitute a contact force application system for causing the outside face 131*b* of the plate 131 of the stripper 130 to apply a contact force against the exposed face 20*a* of a fiber preform 20 for needling.

The needle board 122 faces the inside face 131*a* of the plate 131 of the stripper 130, the needles 123 being in alignment with the perforations 1310 present in the plate 131 of the stripper. The needling head 121 includes a drive system configured to drive the needle board, which drive system is constituted in the presently-described example by two pistons 124 and 125 serving to move the needle board 122, and consequently the needles 123 so they perform reciprocating or back-and-forth motion M along the axis Y relative to the plate of the stripper. During actuation of the pistons 124 and 125, the needles 123 pass in alternation from a retracted position in which they do not project from the outside surface 131*b* of the plate 131 of the stripper 130 (FIG. 3A) to a deployed position in which they project from the outside face 131*b* of the plate 131 in order to penetrate into the fiber preform 20 to a determined depth (FIG. 3B).

In the presently-described example, the needle board 122 carries a plurality of rows of needles 123 arranged one above another along an axis Z (FIG. 1), each row of needles extending over a determined width along the axis X. The perforations 1310 present in the plate 131 of the stripper are arranged in corresponding manner so as to be in alignment with the needles 123, i.e. over a plurality of rows that are located one above the other along the axis Z, and in each row, they are arranged over a determined width along the axis X. Nevertheless, the needle board could equally well have only one row of needles, with the arrangement of the perforations present in the plate of the stripper being adapted accordingly.

In accordance with an embodiment of the invention, the needling installation 100 is also suitable for controlling the contact force application system so that the plate of the stripper applies a force that is predetermined as a function of force measurement information and of at least one target value for a predetermined contact force. For this purpose, the installation includes at least one contact force sensor or compression force sensor suitable for providing information that is representative of the force with which the outside face of the plate of the stripper is making contact against the preform. In the presently-described example, the first arm 140 connecting the plate 131 of the stripper to the needling head 121 includes a first contact force sensor 142 interposed between the actuator 141 and the needling head 121, the sensor 142 in this example corresponding to a digital load cell, while the second arm 150 connecting the plate 131 of the stripper to the needling head 121 includes a second contact force sensor 152 interposed between the actuator 151 and the needling head 121, the sensor 152 in this example corresponding to a digital load cell.

The needling installation includes a control device or controller having a calculation system or any known programmable device (not shown in FIGS. 1, 2, 3A, or 3B). As shown in FIG. 4, the calculation system or the like are programmed to implement a regulator loop that receives firstly a signal Ic corresponding to information representative of the contact force between the outside face of the plate of the stripper and the preform, the signal Ic being delivered in this example by the contact force sensors 142 and 152, and secondly a signal Ec corresponding to a target value for a predetermined contact force. The calculation system determines the difference between the signal Ic and the signal Ec. If the value of the signal Ic is greater than the value of the signal Ec, then the calculation system performs correction and generate a control signal Sc for the actuators 141 and 151, which respond to this signal by reducing the contact force between the plate of the stripper and the exposed face of the preform in order to reach the target value for the contact force. If the value of the signal Ic is less than the value of the signal Ec, then, after performing correction, the calculation system generates a control signal Sc for the actuators 141 and 151, which respond to this signal by increasing the contact force between the plate of the stripper and the exposed face of the preform in order to reach the target value for the contact force. Finally, if the value of the signal Ic is equal to the value of the signal Ec, then the calculation means generate a zero control signal Sc, which leads to no modification to the contact force applied by the actuators 141 and 151. The target value of a contact force between the outside face of the plate of the stripper and the exposed face of the fiber preform may lie in the range 10 N to 1000 N.

In an embodiment, the calculation system includes various hardware components for performing its intended functions. In addition or alternatively, the calculation system may also include a non-transitory computer readable medium encoded with machine-readable instructions for performing the above-described operations.

At the beginning of needling the preform 20, the carriage platform 110 is moved forwards, i.e. towards the needling module 120, so as to place the exposed face 20*a* of the fiber preform 20 in contact with the outside face 131*b* of the plate 131 of the stripper 130 (FIG. 2). Under such circumstances, the regulator loop of FIG. 4 is activated, and this continues until the end of needling, during which the carriage platform 110 is regularly moved rearwards, i.e. away from the needling module 120, in order to adjust the positioning of the stripper plate relative to the fiber preform 20, which is of thickness that increases progressively as the fiber texture 10 is wound onto the mandrel 113.

According to an optional characteristic of the invention, the needling module 120 is suitable for moving along the axis X (FIGS. 1 and 2). The needling module may be moved along the axis X by moving the needling frame 104 on which the needling module 120 is fastened, the frame 104 being mounted by way of example on rails that are fastened on the stationary frame 101 (not shown in FIGS. 1 and 2). The needling module 120 may also be mounted on the needling frame 104 via an actuator device (not shown in the FIGS. 1 and 2) enabling the module 120 to be moved relative to the frame 104 along the axis X. The movement or the needling module 120 along the axis X serves in particular to needle the entire width of a fiber preform should it present a width that is greater than the zone covered by the needles of the needling head in the direction of the axis X.

Figure 5:
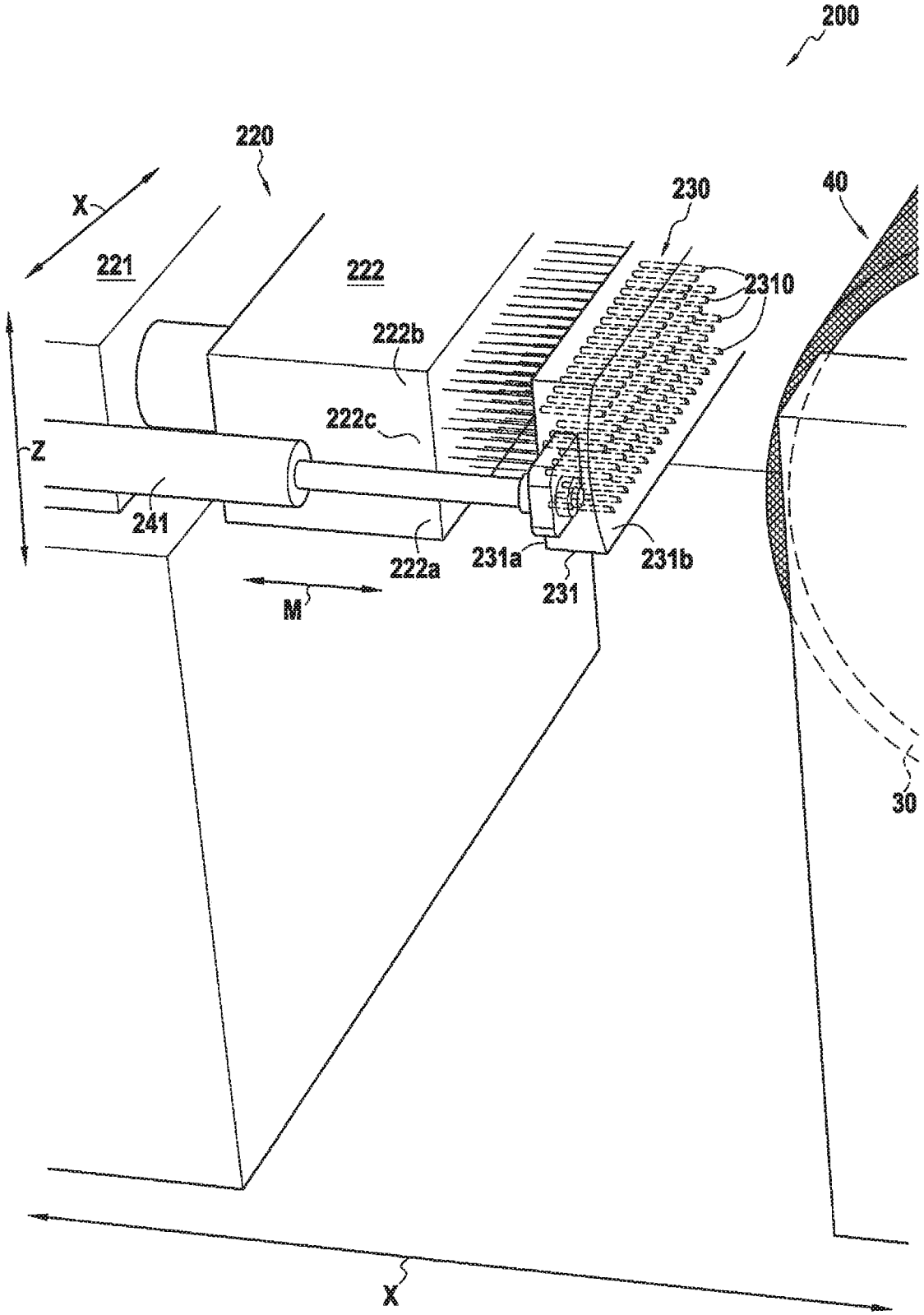
FIG. 5 is a diagrammatic perspective view of a needling installation in another embodiment of the invention.

FIG. 5 shows another embodiment of a needling installation 200 that differs from the above-described needling installation in that the outside face of the plate of the stripper presents concave curvature. More precisely, and as shown in FIG. 5 and as applies likewise for the above-described installation 100, the installation 200 comprises a needling module 220 constituted by a needling head 221, a needle plate 222 mounted on the needling head and carrying a plurality of needles 223, and a stripper 230. The stripper 230 comprises a plate 231 extending at least along a perpendicular axis X and including a plurality of perforations 2310, the plate 231 presenting an inside face 231*a* and an outside face 231*b*, the outside face 231*b* being present beside a mandrel 213 having a fiber texture 30 wound thereon in order to form a needled preform 40. In this embodiment, the outside face 231*b* of the plate 231 of the stripper presents concave curvature. This concave curvature enables it to fit more closely to the shape of the fiber preform 40 and consequently to improve the contact between the outside face 231*b* of the plate 231 of the stripper 230 and the exposed face 40*a* of the fiber preform 40. The concave curvature of the outside face of the stripper plate preferably presents a radius of curvature that is similar to the radius of curvature of the portion of the mandrel 213 that the plate faces.

With a plate 231 that presents an outside face 231*b* with concave curvature, the size of the needles 223 is adapted depending on their position on the needle plate 222 along the axis Z in order to ensure a uniform penetration depth for the needles in the thickness of the preform, the needles being longer in the vicinity of the bottom and top ends 222*a* and 222*b* of the needle plate 222 along the axis Z than the needles present in the vicinity of the middle portion 222*c* of the needle plate along the axis Z.

The other elements of the needling installation 200 are identical to those of the above-described installation 100 and they are not described herein once more for reasons of simplification.

A system other than oleopneumatic actuators could be used for adjusting the contact force between the outside face of the plate of the stripper and the exposed face of the preform. In particular it is possible to use hydraulic or electrical actuators. Likewise, sensors other than load cells could be used for measuring the contact force or the compression force between the outside face of the plate of the stripper and the exposed face of the preform. In particular, sensors using strain gauges or pressure probes could be used.

The invention claimed is:

1. A needling installation comprising:

a rotary support extending along a first axis X and on which a fiber texture can be wound so as to form a fiber preform for a body of revolution, the rotary support being mounted on a frame that is movable along a second axis Y perpendicular to the first axis X;

a stripper comprising at least one plate extending at least along the first axis X and including a plurality of perforations, the plate presenting an inside face and an outside face, the outside face being present beside the rotary support;

a needling module having a needling head and a needle board carrying a plurality of needles, the needle board facing the inside face of the plate of the stripper, the needles being in alignment with the perforations present in the plate of the stripper, the needling head having a drive system configured to drive the needle board to impart reciprocating motion to the needles along the second axis Y relative to said plate of the stripper;

a contact force application system connected to the stripper;

at least one contact force sensor for providing information representative of a contact force with which the outside face of the plate of the stripper makes contact against the fiber preform; and a controller that is configured to control the contact force application system so as to apply a force to the plate of the stripper that is predetermined as a function of information provided by each contact force sensor and as a function of at least one target value for a predetermined contact force.

2. The installation according to claim 1, wherein the stripper is connected to the needling head by arms, each including an oleopneumatic actuator, at least one of the arms further including a contact force sensor.

3. The installation according to claim 1, wherein a target value for a contact force lies in the range 10 N to 1000 N.

4. The installation according to claim 1, wherein the needling module is configured to move along the first axis X.

5. The installation according to claim 1, wherein the outside face of the plate of the stripper presents concave curvature.

6. The installation according to claim 1, wherein the contact force application system includes a plurality of oleopneumatic actuators configured to cause the outside face of the plate of the stripper to apply the contact force against the exposed face of a fiber preform for needling.

7. The installation according to claim 1, wherein the drive system includes a plurality of pistons configured to drive the needle board.

8. A method of needling a fiber preform in a needling installation including a rotary support extending along a first axis X and on which a fiber texture is wound so as to form a fiber preform for a body of revolution, the rotary support being mounted on a frame that is movable along a second axis Y perpendicular to the first axis N;

a stripper comprising at least one plate extending at least along the first axis X and including a plurality of perforations, the plate presenting an inside face and an outside face, the outside face being present beside the rotary support;

a needling module having a needling head and a needle board carrying a plurality of needles, the needle board facing the inside face of the plate of the stripper, the needles being in alignment with the perforations present in the plate of the stripper, the needling head having a drive system configured to drive the needle board to impart reciprocating motion to the needles along the second axis Y relative to said plate of the stripper;

a contact force application system connected to the stripper; and at least one contact force sensor for providing information representative of the force with which the outside face of the plate of the stripper makes contact against the fiber preform, the method comprising:

putting the outside face of the plate of the stripper into contact with the exposed face of the fiber preform and needling said preform; and controlling the contact force applied by the plate of the stripper on the fiber preform, by controlling the contact force application system so as to apply a force to the plate of the stripper that is predetermined as a function of information provided by each contact force sensor and as a function of at least one value for a predetermined contact force.

9. The method according to claim 8, wherein the stripper is connected to the needling head by arms, each including an oleopneumatic actuator, at least one of the arms further including a contact force sensor.

10. The method according to claim 8, wherein a target value for a contact force lies in the range 10 N to 1000 N.

11. The method according to claim 8, wherein the needling module is configured to move along the first axis X.

12. The method according to claim 8, wherein the outside face of the plate of the stripper presents concave curvature.

13. The method according to claim 8, wherein the contact force application system includes a plurality of oleopneumatic actuators configured to cause the outside face of the plate of the stripper to apply the contact force against the exposed face of a fiber preform for needling.

14. The method according to claim 8, wherein the drive system includes a plurality of pistons configured to drive the needle board.

* * * * *